US011067354B2

(12) United States Patent
Lindström et al.

(10) Patent No.: US 11,067,354 B2
(45) Date of Patent: Jul. 20, 2021

(54) BREECH AND METHOD FOR NOISE REDUCTION

(71) Applicant: SAAB AB, Linköping (SE)

(72) Inventors: Mathias Lindström, Hallsberg (SE); Peter Karlsson, Sköllersta (SE); Göran Backlund, Linköping (SE); Ingrid Söderquist, Linköping (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 16/613,630

(22) PCT Filed: May 17, 2017

(86) PCT No.: PCT/SE2017/050521
§ 371 (c)(1),
(2) Date: Nov. 14, 2019

(87) PCT Pub. No.: WO2018/212691
PCT Pub. Date: Nov. 22, 2018

(65) Prior Publication Data

US 2020/0200499 A1 Jun. 25, 2020

(51) Int. Cl.
*F41A 21/30* (2006.01)
*F41A 1/08* (2006.01)
(Continued)

(52) U.S. Cl.
CPC ..... *F41A 21/30* (2013.01); *F41A 1/08* (2013.01); *F41A 21/28* (2013.01); *F41A 21/34* (2013.01); *F41A 21/36* (2013.01); *F41F 3/0455* (2013.01)

(58) Field of Classification Search
CPC ..... F41A 21/30; F41A 21/28; F41A 21/34; F41A 21/36; F41A 1/08; F41F 3/0455
(Continued)

(56) References Cited

U.S. PATENT DOCUMENTS 2,900,875 A * 8/1959 Fergus ..... F41A 21/34 89/14.3
3,183,664 A * 5/1965 Divone ..... F02K 9/976 239/265.35
(Continued)

FOREIGN PATENT DOCUMENTS

EP 1936317 A1 6/2008

OTHER PUBLICATIONS

International Search Report and Written Opinion in corresponding International Application No. PCT/SE2017/0508521 dated Feb. 8, 2018 (12 pages).
(Continued)

*Primary Examiner* — John Cooper
(74) *Attorney, Agent, or Firm* — Sage Patent Group

(57) ABSTRACT

A breech for noise reduction in a recoil-less weapon is described. The breech is adapted to be arranged in fluid communication with a launcher of the weapon to release exhaust gas. The breech comprises a venturi tube. The venturi tube has an inlet at a first end adapted to be connected to the launcher, and an outlet for releasing the exhaust gas at a second end, wherein the area of the outlet is larger than the area of the inlet. The venturi tube further comprises an exhaust gas controlling element formed at the venturi tube structure. The exhaust gas controlling element is arranged to control the release of exhaust gas so as to decrease a sound pressure peak at the weapon. The inner envelope surface of the venturi tube is configured, such that the inner envelope surface does not alter or at least has a very small influence on recoil characteristics of the weapon.

15 Claims, 4 Drawing Sheets

(51) Int. Cl.

| | |
|---|---|
| *F41A 21/28* | (2006.01) |
| *F41A 21/34* | (2006.01) |
| *F41A 21/36* | (2006.01) |
| *F41F 3/045* | (2006.01) |

(58) Field of Classification Search
USPC ..... 89/1.703, 1.7, 1.704, 1.705
See application file for complete search history.

(56) References Cited

U.S. PATENT DOCUMENTS

| | | | | | |
|---|---|---|---|---|---|
| 3,561,679 | A * | 2/1971 | Lager | F02K 9/976 | 239/265.11 |
| 4,091,709 | A * | 5/1978 | Spurk | F41A 1/08 | 239/265.11 |
| 4,203,347 | A * | 5/1980 | Pinson | F41A 1/08 | 89/1.703 |
| 4,404,887 | A * | 9/1983 | Piesik | F41F 3/0455 | 89/1.703 |
| 7,624,668 | B1 * | 12/2009 | Sanford | F41A 1/10 | 102/437 |
| 8,545,646 | B1 * | 10/2013 | Sanford | F41A 1/10 | 149/42 |
| 9,200,597 | B1 * | 12/2015 | Pinera | F02K 9/80 | |
| 2009/0031912 | A1 * | 2/2009 | Gilbert | F41A 1/08 | 102/437 |
| 2017/0067711 | A1 * | 3/2017 | Slack | F41A 21/30 | |

OTHER PUBLICATIONS

International Preliminary Report on Patentability in corresponding International Application No. PCT/SE2017/0508521 dated Apr. 8, 2019 (6 pages).

Extended European Search Report in corresponding European Application No. 17910263.7 dated Nov. 11, 2020 (9 pages).

* cited by examiner 100
102
103

105
106
104
200
203
202
215

201

210
209
207
208

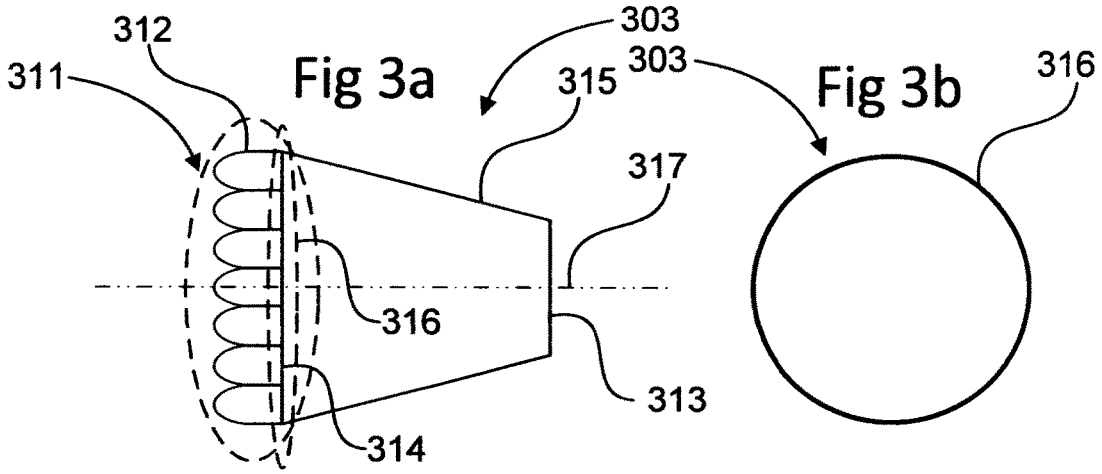
Fig 3a
Fig 3b
303
303
311
312
315
316
317
316
313
314
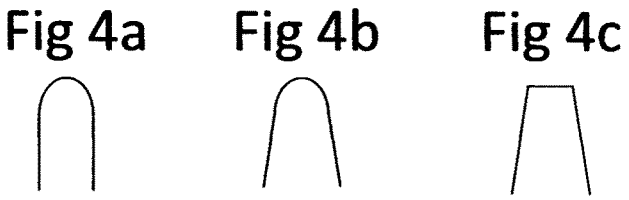
Fig 4a
Fig 4b
Fig 4c
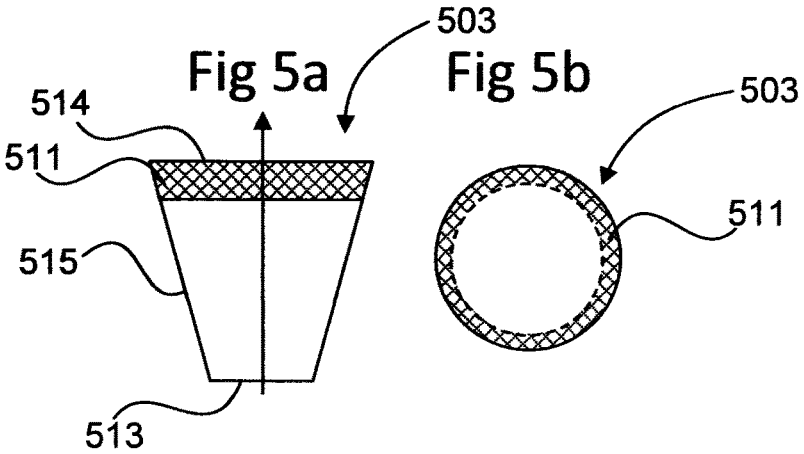
Fig 5a
Fig 5b
503
503
514
511
515
511
513
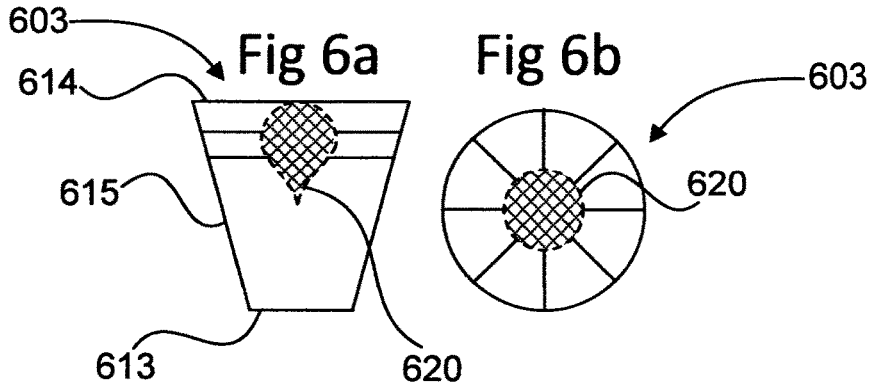
Fig 6a
Fig 6b
603
603
614
615
620
613
620

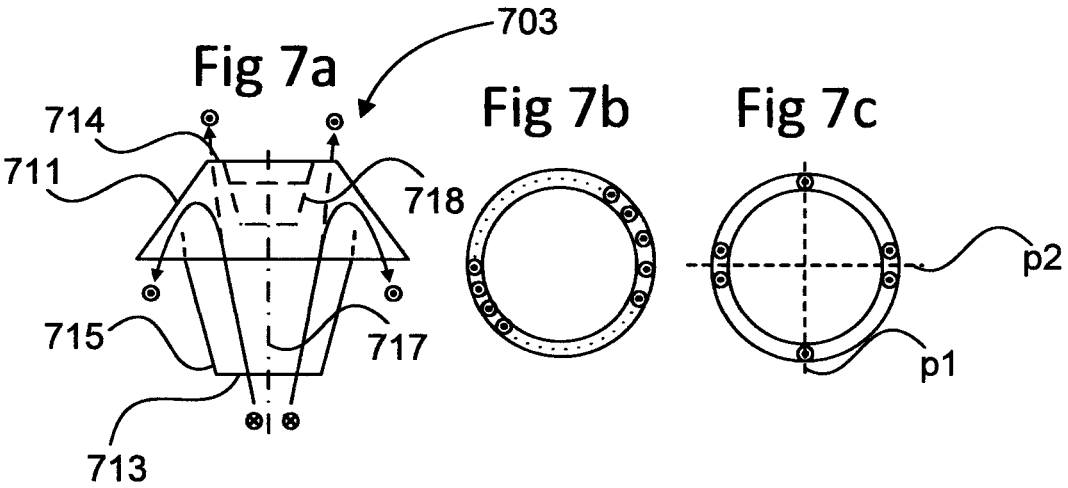
703
Fig 7a
714
711
718
715
717
713
Fig 7b
Fig 7c
p2
p1
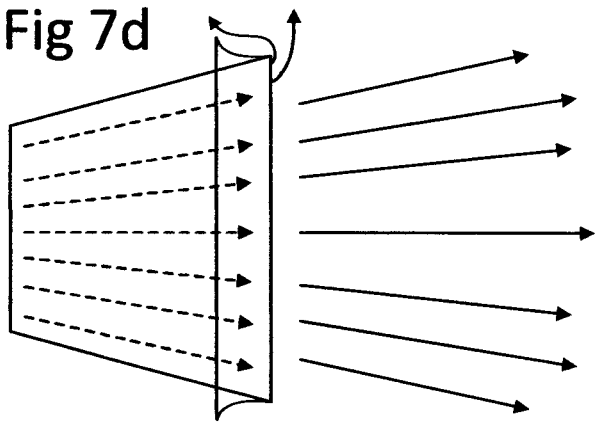
Fig 7d
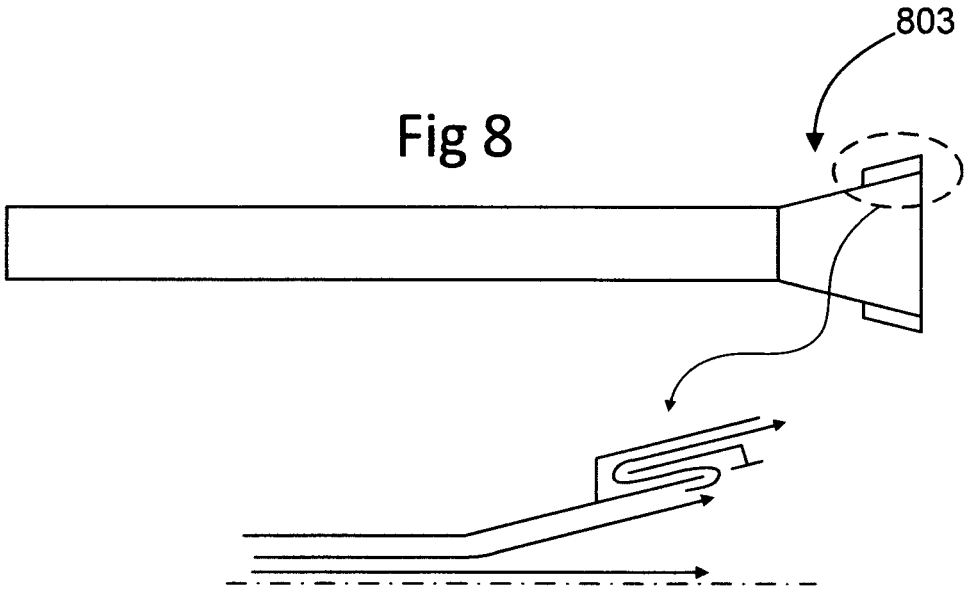
803
Fig 8

S10
Forming a breech comprising a venturi tube having an inlet at a first end adapted to be connected to a launcher of a recoil-less weapon, and an outlet for releasing the exhaust gas at a second end, wherein the area of the outlet is larger than the area of the inlet; and an exhaust gas controlling element formed at the venturi tube structure, said exhaust gas controlling element being arranged to control the release of exhaust gas

Fig 9

BREECH AND METHOD FOR NOISE REDUCTION

CROSS-REFERENCE TO RELATED APPLICATIONS

This application is a U.S. National Stage application of PCT/SE2017/050521, filed May 17, 2017 and published on Nov. 22, 2018 as WO/2018/212691, all of which is hereby incorporated by reference in its entirety.

TECHNICAL FIELD

The present invention relates to a breech for noise reduction in a recoil-less weapon and a recoil-less weapon comprising such a breech.

BACKGROUND ART

Recoil-less weapons, specifically recoil-less rifles, comprises a launcher constituting a guide for a projectile or a missile. When the weapon is fired the projectile is guided by the launcher and leaves the front end of the launcher towards the target. A flame also is created when the weapon is fired, which causes creation of exhaust gases of high temperature. In order to reduce the pressure of the created gases, and thus to decrease the recoil of the weapon, a breech or nozzle is typically arranged at the rear end of the launcher.

A common problem with known breeches is, however, that they cause high levels of noise. The peak sound pressure is often very high due to the sudden release of high pressure exhaust gases from the breech. There exist solutions for reducing such noise of recoil-less weapons. For example, U.S. Pat. No. 4,203,347 discloses a chock suppressing device adapted to be attached to the aft end of a shoulder-fired rocket launcher. The chock suppressing device consists of several concentric, telescoping cylinders which serve to reduce the noise level when the weapon is fired. U.S. Pat. No. 4,091,709 relates to a recoil-less rifle with a nozzle comprising a plurality of openings for noise level reduction.

SUMMARY

Despite known solutions in the field there is still a need to develop and improve the known techniques, such that the noise levels are reduced while maintaining or improving the recoil characteristics of present weapons.

An object of the invention is therefore to achieve a new and advantageous breech for a recoil-less weapon, which reduces noise levels without adversely affecting the recoil characteristics of the weapon.

The herein mentioned object is achieved by a breech for a recoil-less weapon and a recoil-less weapon comprising such a breech according to the independent claims.

Hence, according to an aspect of the invention a breech for a recoil-less weapon is provided. The breech is adapted to be arranged in fluid communication with a launcher of the weapon to release exhaust gas.

The breech comprises a venturi tube having an inlet at a first end adapted to be connected to the launcher, and an outlet for releasing the exhaust gas at a second end. The area of the outlet is larger than the area of the inlet. The effect of this is that the velocity of the gas stream is increased in the direction of the area expansion, i.e. the main flow direction, due to a gas flow cross section increase/expansion. The inner envelope surface of the venturi tube is configured, such that the inner envelope surface does not alter or at least has a very small influence on recoil characteristics of the weapon. This means that the increased velocity of the gas stream in the main flow direction gives an increased impulse balancing the impulse in the opposite direction given to the projectile. In other words, the inner envelope surface of the venturi tube is arranged to increase a velocity of the gas stream in a main flow direction thereby an increased impulse is generated balancing the impulse in the opposite direction given to the projectile.

The breech comprises further an exhaust gas controlling element formed at the venturi tube structure. The exhaust gas controlling element is arranged to control the release of exhaust gas so as to decrease a sound pressure peak at the weapon.

The exhaust gas controlling element lowers the sound pressure locally at the recoil-less weapon. Thereby the environment for the operators of the weapon, such as shooter and loader, is improved. The breech decreases the sound pressure for the operator without affecting the inner ballistics of the weapon or recoil adversely.

The exhaust gas controlling element formed at the venturi tube structure is arranged to control the release of exhaust gas so as to successively release high pressure gas and/or reduce radial pressure distribution and/or obtain destructive interference and/or obtain additional area enlargement.

According to some aspects, the exhaust gas controlling element formed at the venturi tube structure is arranged to control the release of exhaust gas so as to successively release high pressure gas and/or reduce radial pressure distribution and/or obtain destructive interference and/or obtain additional area enlargement. The exhaust gas controlling element thereby reduces the pressure peak and the sound pressure level due to sudden release of high pressure exhaust gases during firing. The reduced radial pressure distribution may further reduce deviation from the intended firing direction by reducing perturbation perpendicular to a longitudinal axis of a launcher of the recoil-less weapon at which the breech is arranged.

According to some aspects, the exhaust gas controlling element formed at the venturi tube structure comprises a plurality of teeth arranged at the venturi tube circumference so that the exhaust gas control element at least controls the release of exhaust gas by successively releasing high pressure gas. By successively releasing the high pressure gas, the wave front is broken and the peak sound pressure is decreased.

According to some aspects, the gas controlling element formed at the venturi tube structure comprises a porous material forming the venturi tube structure at least a portion of the venturi tube, whereby the venturi tube structure at least controls the release of exhaust gas by successively releasing high pressure gas. By successively releasing the high pressure gas, the wave front is broken and the peak sound pressure is decreased.

According to some aspects, the porous material has an irregular structure or network structure. An irregular structure or network structure enables varying the release of high pressure gas. In other words, the successive release of high pressure gas may vary over the gas controlling element, thereby tailoring how the wave front is broken. For instance, different regions of the wave front can be made to interact to cause destructive interference, thereby reducing the peak sound pressure further.

According to some aspects, the density of the porous material decreases in the main flow direction of the exhaust gas, thereby progressively releasing high pressure gas. By successively releasing the high pressure gas, the wave front is broken and the peak sound pressure is decreased.

According to some aspects, the gas controlling element formed at the venturi tube structure comprises a gas channel formed at the exterior of the venturi tube and connected to an opening in the venturi tube structure, wherein the channel comprises a first channel part leading the gas in a direction substantially opposite the main gas flow direction in the venturi tube.

According to some aspects, the channel is formed on the outside of the venturi tube.

By forming the gas channel at the exterior of the venturi tube, the exhaust gas is distributed over a volume having a greater radial distribution with respect to the venturi tube. The greater radial distribution implies that the gas is distributed over a greater circumference, i.e. the density of gas is reduced. In other words, at least a radial pressure distribution is reduced.

According to some aspects, the channel is in the shape of a labyrinth.

According to some aspects, the channel comprises a second channel part in fluid communication with the first channel part and arranged to exhaust gas in a direction substantially coaxially with the main exhaust flow of the venturi tube, wherein the gas controlling element has a geometrical design to obtain destructive interference.

The labyrinth shape enables exhaust gas to be released at different locations, at different quantities and with a phase shift relative a main exhaust flow of the venturi tube. Different wave fronts of exhaust gas can thereby be generated, which can be arranged to interact. With a suitable geometrical design of the gas controlling element, destructive interference is obtained. The destructive interference significantly reduces the sound pressure level associated with the pressure peak.

According to some aspects, the breech further comprises an additional gas controlling element comprising a porous body insertable in the venturi tube to successively release high pressure gas.

According to some aspects, the porous body is arranged centrally inside the breech.

According to some aspects, the porous body increases in size in direction towards the outlet.

A porous body will progressively release high pressure gas passing through it. Arranging the porous body centrally inside the breech further affects the flow of exhaust gas to flow symmetrically about the porous body in addition to passing through it. The porous body can thereby be arranged such that the progressive release of high pressure gas passing through the porous body will interfere destructively with the exhaust gas flowing along a main exhaust flow of the venturi tube. According to some aspects, the porous body increases in size in direction towards the outlet.

According to some aspects, the breech is created by Additive Manufacturing. Additive manufacturing ensures that the breech is made as a single piece, thereby avoiding weak points caused by merging two or more objects by e.g. welding. Additive manufacturing further extends the range of possible geometries of the breech. For instance, additive manufacturing enables precise control over porosity patterns. The porosity can be varied e.g. according to a generative design and/or a genetic algorithm.

The present disclosure also relates to a recoil-less weapon comprising a launcher. The launcher is arranged to provide a guide for a projectile or a missile. The recoil-less weapon further comprises a breech as illustrated above and below. The recoil-less weapon has all the technical effects and advantages of the breech, as described above and below.

The present disclosure also relates to a method for manufacture of a breech for a recoil-less weapon. The breech is adapted to be arranged in fluid communication with a launcher of the weapon to release exhaust gas. The method comprises one step of forming the breech. The breech comprises a venturi tube. The venturi tube has an inlet at a first end adapted to be connected to the launcher. The venturi tube further has an outlet for releasing the exhaust gas at a second end. The area of the outlet is larger than the area of the inlet. The breech further comprises an exhaust gas controlling element formed at the venturi tube structure. The exhaust gas controlling element is arranged to control the release of exhaust gas so as to decrease a sound pressure peak at the weapon. The inner envelope surface of the venturi tube is configured, such that the inner envelope surface does not alter or at least has a very small influence on the recoil characteristics of the weapon. The method produces a breech as disclosed above and below, having all the disclosed technical effects and advantages.

BRIEF DESCRIPTION OF THE DRAWINGS

FIGS. 3*a*-3*b* disclose one example of a breech having a plurality of teeth formed along the circumference at the second end;

FIGS. 4*a*-4*c* disclose different types of teeth;

FIGS. 5*a*-5*b* disclose another example of a breech having a porous material formed along the circumference at the second end;

FIGS. 6*a*-6*b* disclose an example of a breech having a porous body inserted therein;

FIGS. 7*a*-7*d* disclose further examples of a breeches having an inverted funnel;

FIG. 8 discloses still yet another example of a breech having exterior channel; and FIG. 9 discloses a method for manufacture of a breech for a recoil-less weapon.

DETAILED DESCRIPTION

Figures 1, 2A, 2B, 2C, 2D, 2E, 2F:
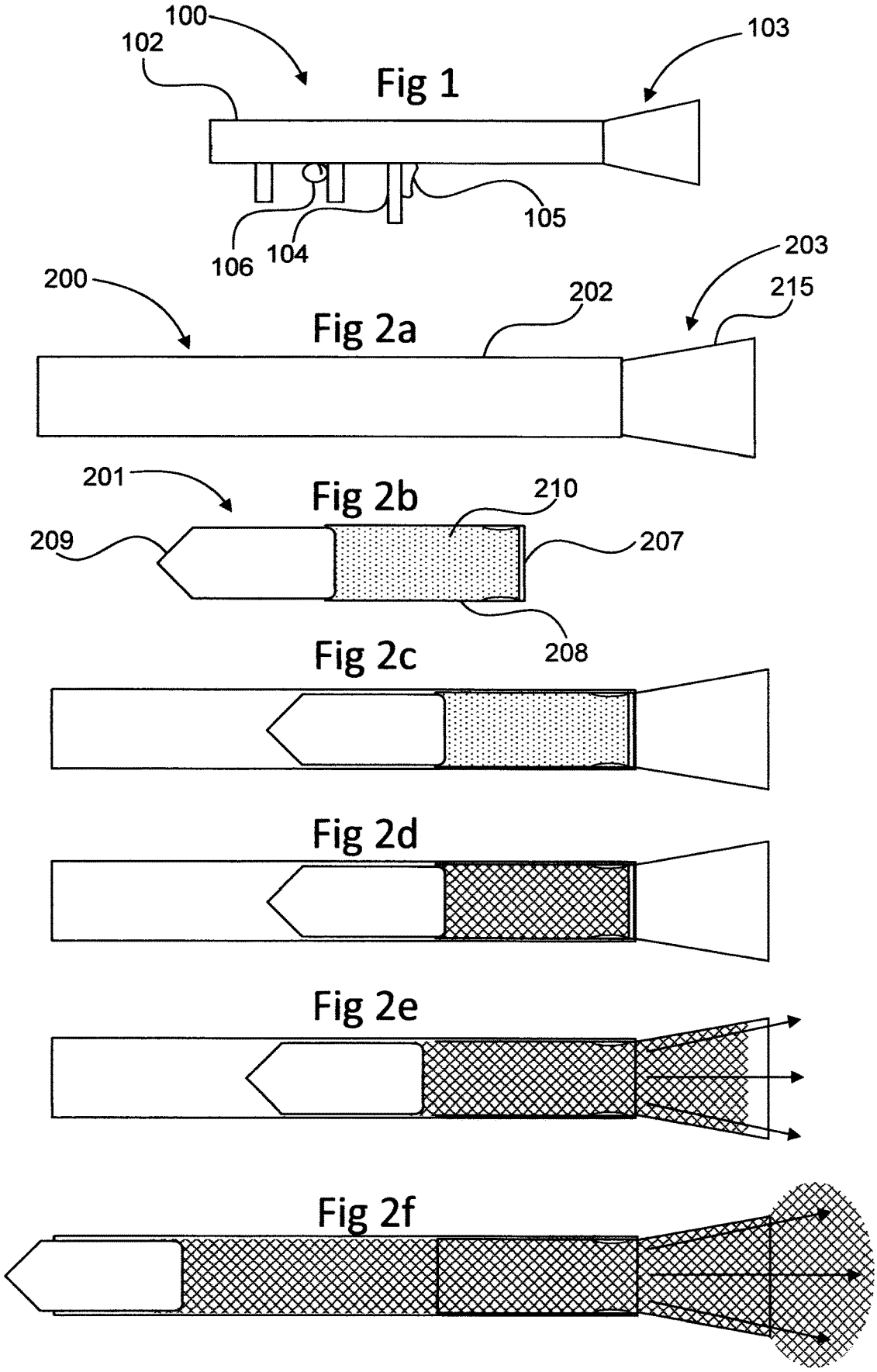
FIG. 1 is a side view schematically disclosing a recoil-less weapon.
FIGS. 2*a*-2*f* schematically disclose the operation of a recoil-less weapon.

Aspects of the present disclosure will be described more fully hereinafter with reference to the accompanying drawings. The breech and recoil-less weapon disclosed herein can, however, be realized in many different forms and should not be construed as being limited to the aspects set forth herein. Like numbers in the drawings refer to like elements throughout.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

The disclosure relates to a breech for noise reduction in a recoil-less weapon. The breech is adapted to be arranged in fluid communication with a launcher of the weapon to release exhaust gas. The breech comprises venturi tube and an exhaust gas controlling element formed in the venturi tube structure and arranged to control the release of exhaust gas. The release of exhaust gas is controlled so as to successively release high pressure gas and/or reduce radial pressure distribution and/or obtain destructive interference and/or obtain additional area enlargement.

In FIGS. 2*a*-2*f*, the principle of a recoil-less weapon is schematically illustrated. In FIG. 2*a*, an unloaded recoil-less weapon 200 is disclosed. The recoil-less weapon 200 comprises a launcher 202 and breech 203. The breech comprises a venturi tube 215. The launcher comprises a barrel arranged to form a guide for ammunition. The launcher 202 is arranged to receive ammunition.

In FIG. 2*b*, ammunition 201 for a recoil-less weapon is schematically illustrated. The ammunition 201 comprises a base plate 207, a cartridge case 208 and a projectile 209. The base plate 207, the cartridge case 208 and the projectile 209 are arranged to enclose a volume for holding propellant. The ammunition further comprises propellant 210. The propellant 210 is arranged in the volume for holding the propellant. The cartridge 208 preferably has a circular cross section. The cartridge has first and second ends. The projectile 209 is preferably arranged at the first end and the base plate 207 at the second end. According to some aspects, the base plate 207 is arranged to rupture when subjected to a predetermined pressure.

In FIG. 2*c*, the recoil-less weapon 200 loaded with ammunition is schematically illustrated. The ammunition is arranged with the base plate facing the venturi tube.

In FIG. 2*d*, an initial stage of ignition of the propellant of the ammunition disclosed in FIG. 2*c* is disclosed. As the propellant is ignited, there is a rapid increase in pressure due to expansion of exhaust gas. The expanding gas exerts pressure on the projectile and the base plate.

In FIG. 2*e*, a stage following the initial stage of ignition of the propellant is illustrated. The pressure exerted on the projectile causes the projectile detach from the cartridge case and begin to accelerate. The pressure exerted on the base plate reaches a predetermined pressure at which the base plate ruptures, thereby enabling the expanding gas to flow into the venturi tube.

In FIG. 2*f*, a stage following the stage illustrated in FIG. 2*e*, the projectile leaves the barrel and gas flows through the venturi tube. Due to conservation of momentum between the projectile moving in one direction and the expanding gas flowing through the venturi tube in essentially the opposite direction, recoil is counteracted. In other words, the gas massflow through the venturi tube counteracts recoil.

In FIG. 1, a recoil-less weapon 100 is disclosed. The recoil-less weapon 100 comprises a launcher 102. The launcher forms a guide for the ammunition. The recoil-less weapon comprises further a breech 103. The breech 103 is arranged at a rear part of recoil-less weapon 100. In one example, the breech 103 is mounted in a detachable fashion. In one example, the breech is arranged to be mounted to the launcher by means of a fastening arrangement detachably fastening the breech to the launcher 102. Examples of fastening element for detachably fastening comprise the fastening element being arranged to receive screws and/or nuts and bolts and arranged to fasten the breech 103 to the rear part of the recoil-less weapon by means of the received screws and/or nuts and bolts, the rear part of recoil-less weapon and the breech 103 having matching threads arranged to enable the breech 103 being screwed onto the rear part of the recoil-less weapon; and/or a clamping mechanism arranged to detachably fasten the breech 103 to the rear part of the recoil-less weapon. In one example, the breech 103 is mounted in a permanent fashion. In one example, the breech is arranged to be mounted to the launcher by means of a fastening arrangement permanently fastening the breech to the launcher 102. Examples of fastening element for permanent fastening comprise the breech 103 and the rear part of the recoil-less weapon being formed together during manufacturing, i.e. the rear part of the recoil-less weapon being arranged to form a breech, or the breech 103 being welded to the rear part of the recoil-less weapon.

The breech 103 comprises a venturi tube having an inlet at a first end adapted to be connected to the launcher, as disclosed above, and an outlet for releasing the exhaust gas at a second end. The area of the outlet is larger than the area of the inlet.

The effect of this is that the velocity of the gas stream is increased in the direction of the area expansion, i.e. the main flow direction, due to a gas flow cross section increase/expansion. The inner envelope surface of the venturi tube is configured, such that the inner envelope surface does not alter or at least has a very small influence on recoil characteristics of the weapon. This means that the increased velocity of the gas stream in the main flow direction gives an increased impulse balancing the impulse in the opposite direction given to the projectile. In other words, the inner envelope surface of the venturi tube is arranged to increase a velocity of the gas stream in a main flow direction thereby an increased impulse is generated balancing the impulse in the opposite direction given to the projectile.

The breech comprises further an exhaust gas controlling element (not shown) formed at the venturi tube structure. The exhaust gas controlling element is arranged to control the release of exhaust gas so as to decrease a sound pressure peak at the weapon. The exhaust gas controlling element formed at the venturi tube structure is arranged to control the release of exhaust gas so as to successively release high pressure gas and/or reduce radial pressure distribution and/or obtain destructive interference and/or obtain additional area enlargement.

The recoil-less weapon is for example a recoil-less rifle or a recoil-less gun. The recoil-less rifle has a rifled barrel. Recoil-less guns are smoothbore variants. The recoil-less rifle or recoil-less gun is a type of lightweight tube artillery that is designed to allow some of the propellant gases to escape out the rear of the weapon at the moment of ignition, creating forward thrust that counteracts some of the weapon's recoil. This allows for the elimination of much of the heavy and bulky recoiling mechanisms of a conventional cannon while still enabling the recoil-less weapon to fire a powerful projectile.

Alternatively, the recoil-less weapon is a rocket launcher.

The recoil-less weapon may be arranged to fire artillery ammunition. The artillery ammunition may or may not have propulsion of its own. The artillery ammunition may be a projectile or missile.

The recoil-less weapon is in one example adapted to be shoulder-fired by individual infantrymen. The recoil-less weapon is in one example adapted to be mounted on a bipod The recoil-less weapon is in one example adapted to be mounted on a tripod. The recoil-less weapon is in one example adapted to be vehicle mounted.

The recoil-less weapon in the illustrated example may comprise a mount 104 for mounting the recoil-less weapon on a tripod and/or a vehicle and/or a shoulder mount 105.

The recoil-less weapon has in the illustrated example an actuator 106 for a trigger mechanism for firing of the weapon.

In FIGS. 3*a* and 3*b*, a breech 303 is illustrated comprising a venturi tube 315 and an exhaust gas controlling element 311. The venturi tube 315 comprises an inlet at a first end 313 adapted to be connected to a launcher of a recoil-less weapon. The venturi tube 315 comprises further an outlet at a second end 314. The exhaust gas controlling element 311 is arranged at the second end 314 forming an extension of the venturi tube 315. The exhaust gas controlling element 311 comprises in accordance with this example a plurality of teeth 312 extending from a circumference 316 of the venturi tube 315 at the second end 314. The teeth 312 are in the illustrated example arranged at the circumference 316 with substantially no distance there between. Alternatively, the teeth 312 are arranged in a spaced apart manner. In one example, teeth 312 are provided along the entire circumference 316 while in another example, the teeth 312 are arranged along a part or parts of the circumference 316. According to some aspects, one or more teeth can be moved and/or removed/replaced. In other words, the distance between the teeth can be adjusted. Furthermore, the number of teeth and/or the type of teeth can be adjusted.

The respective teeth 312 are all in the illustrated example extending in a direction coaxial with a longitudinal axis 317 of the breech, and in its extension, the recoil-less weapon, when the breech is mounted thereto. In an alternative example, at least some of the teeth 312 extend in a different direction. In one example, some or all of the teeth 312 extend in a direction coinciding with an extension of the venturi tube wall.

In FIG. 3*a* the teeth 312 are illustrated uniformly shaped, i.e. all teeth have the same shape. Each individual tooth 312 may however have any suitable shape. Some examples of tooth shapes will be given in relation to FIG. 4*a*-4*c*. Further, the thickness and/or density distribution along the extension of the respective tooth may also be of any suitable design.

The exhaust gas controlling element 311 comprising the circumferentially arranged teeth controls the release of exhaust gas by successively releasing high pressure gas. By successively releasing the high pressure gas, the wave front is broken and accordingly, the sound pressure peak is decreased in magnitude. The successive release of high pressure gas is obtained along the extension of the teeth. The different designs of the exhaust gas controlling element 311 comprising the teeth 312 may be so arranged that a progressive release of high pressure gas is achieved.

The breech including the venturi tube 315 and the exhaust gas controlling element 311 is in one example manufactured by Additive Manufacturing, i.e. by 3D printing. Accordingly, the breech is manufactured in one piece and the desired characteristics of the breech can be designed freely.

FIGS. 4*a*-4*c* illustrate examples of design of the individual teeth. In the illustrated examples they have either a rounded edge, as in FIGS. 4*a* and 4*b*, or a flat edge, as in FIG. 4*c*. Further examples (not shown) comprises edges having bullnose, bevel, double bevel, triple bevel, concave, convex, straight, ogee or triple ogee cross sections. The body of the individual teeth may be either straight, FIG. 4*a*, or tapered, FIGS. 4*b* and 4*c*.

In FIGS. 5*a* and 5*b*, a breech 503 is illustrated comprising a venturi tube 515 and an exhaust gas controlling element 511. The venturi tube 515 comprises as discussed for example in relation to FIGS. 3*a*, 3*b* an inlet at a first end 513 adapted to be connected to a launcher of a recoil-less weapon. The venturi tube 515 comprises further an outlet at a second end 514. The exhaust gas controlling element 511 is arranged at the second end 514 forming an extension of the venturi tube 515. The exhaust gas controlling element 511 forms in accordance with this example a venturi tube extension part. The gas controlling element 511 comprises a porous material forming the venturi tube structure at least a portion of the venturi tube. Thereby, the venturi tube structure at least controls the release of exhaust gas by successively releasing high pressure gas. The wave front is thereby broken and the sound peak is decreased. The porous material may have an irregular structure and/or network structure.

The density of the porous material may decrease in the gas flow direction, thereby progressively releasing high pressure gas.

The breech including the venturi tube 515 and the exhaust gas controlling element 511 is in one example manufactured by Additive Manufacturing, i.e. by 3D printing. Accordingly, the breech is manufactured in one piece and the desired characteristics of the breech can be designed freely.

FIGS. 6*a* and 6*b* illustrate a breech 603 comprising a venturi tube 615 and an exhaust gas controlling element (not shown). The exhaust gas controlling element can be of any type for example as disclosed herein or a combination thereof. The breech comprises further an additional gas controlling element comprising a porous body 620 insertable in the venturi tube to successively release high pressure gas. The porous body 620 may be arranged centrally inside the breech. In some examples the porous body is arranged to increase in size in direction towards the outlet. In some further examples, the porous body has a varying porosity. Stated differently, the porous body may be arranged to have a varying density. By an appropriate choice of gradually increasing and/or decreasing the density of the porous body in direction towards the outlet, successive pressure release is achieved. In other words, the porous body is arranged for successive pressure release. By the successive pressure release, the pressure peak of exhaust gases is reduced. According to some aspects, the porous body is manufactured by additive manufacturing. Additive manufacturing opens up designs and/or material choices for the porous body not available through other manufacturing methods for manufacturing porous bodies. In particular, additive manufacturing enables porous bodies designed by means of e.g. generative design, parametric design, genetic algorithms, cellular automata or any combination thereof. The different design methods enable precise control over the shapes and distribution of the pores of the porous body while at the same time optimizing the shapes and distribution of the pores to match one or more design objectives, e.g. successive pressure release. The effects of randomly distributed and randomly shaped pores can thereby be reduces or eliminated. In particular, the porous body may be arranged to possess a spatial symmetry, e.g. rotation by a predetermined number of degrees about a symmetry axis. For instance, the porous body in FIG. 6*b* is illustrated as being fixed at eight different points distributed evenly about a central axis of symmetry (not shown). The porous body may be arranged to have an eight-fold symmetry with respect to rotations about the symmetry axis. In other words, the porous body may be arranged to be invariant under forty-five degree rotations about the symmetry axis. The effects of the porous body when arranged in the venture tube will thus be the same for at least eight different arrangements of the porous body; each arrangement being a multiple of a forty-five degree rotation about a central axis with respect to one of the other eight arrangements.

In FIGS. 7*a*-7*c*, a breech 703 is illustrated comprising a venturi tube 715 and an exhaust gas controlling element 711. The venturi tube 715 comprises, as discussed for example in relation to FIGS. 3*a* and 3*b*, an inlet at a first end 713 adapted to be connected to a launcher of a recoil-less weapon. The venturi tube 715 comprises further an outlet at a second end 714. The exhaust gas controlling element 711 comprises a gas channel formed at the exterior of the venturi tube and connected to one or more openings in the venturi tube structure. The channel comprises a first channel part leading the gas in a direction substantially opposite the main gas flow direction in the venturi tube. Thereby, a least a radial pressure distribution at the outlet 714 is reduced. In FIG. 7*a* an example flow direction is illustrated using arrows and small circles with crosses for inwards flow and small circles with a central dot for outwards flow. The gas channel is preferably arranged to distribute the redirected gas flow mirror-symmetrically with respect to at least one plane comprising a centreline 717 of the breech 703. The mirror-symmetry has the technical effect of cancelling out the radial momentum change as the gas is being redirected. Stability of the recoil-less weapon on which the breech 703 is arranged is thereby improved. In FIG. 7*b*, the gas channel is arranged to distribute the redirected gas flow having an even angular distribution about the centreline 717. In FIG. 7*c*, the gas channel is arranged to distribute the redirected gas flow mirror-symmetrically about two planes p1, p2. Due to the symmetry of the gas channel, as the expanding gas pushes against a wall of the gas channel of the exhaust gas controlling element 711, the expanding gas simultaneously pushes in the opposite direction against another wall. In some examples, the exhaust gas controlling element 711 further comprises a gas redirection unit 718. The gas redirection unit 718 has a form factor and a location within the exhaust gas controlling element 711 arranged to redirect a predetermined amount of the expanding gas to the gas channel. In other words, the gas redirection unit 718 is arranged to adjust the amount and the distribution of the expanding gas into the gas channel. For instance, in the example illustrated in FIG. 7*c*, the amount of gas being redirected about a first plane p1 may differ from the amount of gas being redirected about a second pane p2.

FIG. 7*d* illustrates an alternative embodiment of the breech illustrated in FIGS. 7*a*-7*c*. The inverted funnel is arranged outside the venturi tube. The inverted funnel is arranged to redirect the gas flow as it exits the venturi tube. As the gas exits the venturi tube, it is free to expand in a radial direction with respect to a centreline of the breech. As the gas expands in the radial direction, it will interact with itself and some gas will experience pressure to move in a direction opposite the main gas mass flow. The inverted funnel is arranged to redirect some of the expanding gas in a direction at least partially opposite to the direction of the main gas mass flow.

FIG. 8 discloses still yet another example of a breech having exterior channel (circled). The breech is a breech for noise reduction in a recoil-less weapon. The breech is adapted to be arranged in fluid communication with a launcher of the weapon to release exhaust gas. The breech comprises a venturi tube. The venturi tube has an inlet at a first end adapted to be connected to the launcher. The venturi tube also has an outlet for releasing the exhaust gas at a second end. The area of the outlet is larger than the area of the inlet. The breech further comprises an exhaust gas controlling element formed at the venturi tube structure. The exhaust gas controlling element is arranged to control the release of exhaust gas so as to decrease a sound pressure peak at the weapon. The inner envelope surface of the venturi tube is configured, such that the inner envelope surface does not alter or at least has a very small influence on recoil characteristics of the weapon.

The gas controlling element formed at the venturi tube structure comprises a gas channel formed at the exterior of the venturi tube and connected to an opening in the venturi tube structure. The channel comprises a first channel part leading the gas in a direction substantially opposite the main gas flow direction in the venturi tube. The first channel part thereby reduces at least a radial pressure distribution. The channel is formed on the outside of the venturi tube. The channel is in the shape of a labyrinth. The channel may have a cross section which is increasing in the direction of the flow. In other words, the channel is arranged to provide a progressively increasing area enlargement.

The channel comprises a second channel part in fluid communication with the first channel part and arranged to exhaust gas in a direction substantially coaxially with the main exhaust flow of the venturi tube. The second channel part thereby increases the effective area over which the exhaust gas is released. Furthermore, due to the channel being in the shape of a labyrinth, which is manifested by the fluid communication between the first and second channel parts, exhaust gas is led in directions back and forth. By leading exhaust gas in the channel in the disclosed manner, successive release of exhaust gas is achieved. Successive release of gas significantly reduces the pressure peak associated with firing a conventional recoil-less weapon. The reduced pressure peak reduces recoil and sound pressure levels during firing. The gas controlling element preferably has a geometrical design arranged to obtain destructive interference. In other words, the gas controlling element may be arranged such that the exhaust gas from the second channel part and the exhaust gas from a central portion of the venturi tube will interfere destructively with each other. The destructive interference reduces pressure and sound levels of the recoil-less weapon during firing.

FIG. 9 illustrates schematically a method for manufacture of a breech for a recoil-less weapon, the breech being adapted to be arranged in fluid communication with a launcher of the weapon to release exhaust gas. The method may be performed by means of a reciprocating three dimensional printing device. The breech may be made by at least one of stainless steel, aluminium alloys, cobalt-chromium super-alloys, nickel-based super-alloys, titanium alloys, copper alloys and ceramics.

The method comprises preferably only one step of forming the breech S10 comprising a venturi tube having an inlet at a first end adapted to be connected to the launcher, and an outlet for releasing the exhaust gas at a second end, wherein the area of the outlet is larger than the area of the inlet; and an exhaust gas controlling element formed at the venturi tube structure, said exhaust gas controlling element being arranged to control the release of exhaust gas so as to decrease a sound pressure peak at the weapon, wherein the inner envelope surface of the venturi tube is configured, such that the inner envelope surface does not alter or at least has a very small influence on recoil characteristics of the weapon.

The one step of forming the breech S10 may be made by additive manufacturing. Additive manufacturing ensures that the breech is made as a single piece, thereby avoiding weak points caused by merging two or more objects by e.g. welding. Additive manufacturing further extends the range of possible geometries of the breech. For instance, additive manufacturing enables precise control over porosity patterns. The porosity can be varied e.g. according to a generative design and/or a genetic algorithm.

The invention claimed is:

1. A breech for noise reduction in a recoil-less weapon, the breech being adapted to be arranged in fluid communication with a launcher of the weapon to release exhaust gas, the breech comprising:

a venturi tube structure having an inlet at a first end adapted to be connected to the launcher, and an outlet for releasing the exhaust gas at a second end, wherein the area of the outlet is larger than the area of the inlet; and exhaust gas controlling element formed at the venturi tube structure, said exhaust gas controlling element being arranged to control the release of exhaust gas so as to decrease a sound pressure peak at the weapon, wherein the inner envelope surface of the venturi tube structure is configured, such that the inner envelope surface does not alter or at least has a very small influence on recoil characteristics of the weapon, and wherein the exhaust gas controlling element formed at the venturi tube structure is arranged to control the release of exhaust gas so as to successively release high pressure gas and/or reducing radial pressure distribution and/or obtain destructive interference and/or obtain additional area enlargement.

2. The breech according to claim 1, wherein the exhaust gas controlling element formed at the venturi tube structure comprises a plurality of teeth arranged at the venturi tube circumference so that the exhaust gas controlling element at least controls the release of exhaust gas by successively releasing high pressure.

3. The breech according to claim 1, wherein the exhaust gas controlling element formed at the venturi tube structure comprises a porous material forming at least a portion of the venturi tube structure, whereby the venturi tube structure at least controls the release of exhaust gas by successively releasing high pressure gas.

4. The breech according to claim 3, wherein the porous material has an irregular structure or network structure.

5. The breech according to claim 3, wherein the density of the porous material decreases in the main flow direction of the exhaust gas, thereby progressively releasing high pressure gas.

6. The breech according to claim 1, wherein the exhaust gas controlling element formed at the venturi tube structure comprises a gas channel formed at the exterior of the venturi tube structure and connected to an opening in the venturi tube structure, wherein the channel comprises a first channel part leading the gas in a direction substantially opposite the main gas flow direction in the venturi tube structure.

7. The breech according to claim 6, wherein the channel is formed on the outside of the venturi tube structure.

8. The breech according to claim 6, wherein the channel is in the shape of a labyrinth.

9. The breech according to claim 6, wherein the channel comprises a second channel part in fluid communication with the first channel part and arranged to exhaust gas in a direction substantially coaxially with the main exhaust flow of the venturi tube structure, wherein the exhaust gas controlling element has a geometrical design to obtain destructive interference.

10. The breech according to claim 6, further comprising an additional exhaust gas controlling element comprising a porous body insertable in the venturi tube structure to successively release high pressure gas.

11. The breech according to claim 10, wherein the porous body is arranged centrally inside the breech.

12. The breech according to claim 10, wherein the porous body increases in size in direction towards the outlet.

13. The breech according to claim 1, wherein the breech is created by Additive Manufacturing.

14. A recoil-less weapon comprising a launcher, the launcher being arranged to provide a guide for a projectile or a missile, characterized in that the weapon comprises a breech according to claim 1.

15. Method for manufacture of a breech for a recoil-less weapon, the breech being adapted to be arranged in fluid communication with a launcher of the weapon to release exhaust gas, said method comprises one step of forming the breech comprising a venturi tube structure having an inlet at a first end adapted to be connected to the launcher, and an outlet for releasing the exhaust gas at a second end, wherein the area of the outlet is larger than the area of the inlet; and an exhaust gas controlling element formed at the venturi tube structure, said exhaust gas controlling element being arranged to control the release of exhaust gas so as to decrease a sound pressure peak at the weapon, wherein the inner envelope surface of the venturi tube structure is configured, such that the inner envelope surface does not alter or at least has a very small influence on recoil characteristics of the weapon, wherein the step of forming the breech is made by additive manufacturing.

* * * * *